US005986611A

United States Patent [19]

Harrison et al.

[11] Patent Number: 5,986,611

[45] Date of Patent: Nov. 16, 1999

[54] STEERABLE DISK ANTENNA

[75] Inventors: Earnest R. Harrison, Severna Park; Timothy G. Waterman, Eldersburg, both of Md.

[73] Assignee: Northrop Grumman Corporation, Los Angeles, Calif.

[21] Appl. No.: 09/112,426

[22] Filed: Jul. 10, 1998

[51] Int. Cl.[6] ..... H01Q 1/28; H01Q 1/42

[52] U.S. Cl. ..... 343/705; 343/705; 343/708; 343/872

[58] Field of Search ..... 343/705, 708, 343/793, 810, 811, 812, 853, 872

[56] References Cited

U.S. PATENT DOCUMENTS

| | | | |
|---|---|---|---|
| 2,980,909 | 4/1961 | Clanton, Jr. et al. | 343/705 |
| 3,045,236 | 7/1962 | Colman et al. | 343/705 |
| 3,656,164 | 4/1972 | Rempt | 343/705 |
| 3,984,837 | 10/1976 | Tatnall | 343/705 |
| 4,380,012 | 4/1983 | Bevan et al. | 343/705 |
| 4,749,997 | 6/1988 | Canonico | 343/705 |
| 5,049,891 | 9/1991 | Ettinger et al. | 343/705 |

*Primary Examiner*—Hoanganh Le
*Assistant Examiner*—Tan Ho

[57] ABSTRACT

A radar antenna system, adapted to be supported on an aircraft for surveillance, employs a nonconducting disk radome structured with aerodynamic fairing and otherwise to produce relatively low aerodynamic drag. A plurality of struts are used to secure the disk radome to the aircraft with the disk radome generally extending in a solid horizontal reference plane. A plurality of elongated, relatively low gain radiating elements are supported by a ground-plane box within the disk radome, with the radiating elements distributed across the disk radome and disposed to radiate generally in the vertical direction. An electronic system is supported within the ground-plane box, and it includes respective transmit/receive circuits which send and receive radio frequency signals to and from the radiating elements. Power cables extend through the struts to couple signals between the electronic system in the disk radome and radar system level circuitry located externally of the disk radome.

14 Claims, 3 Drawing Sheets

FIG. 1
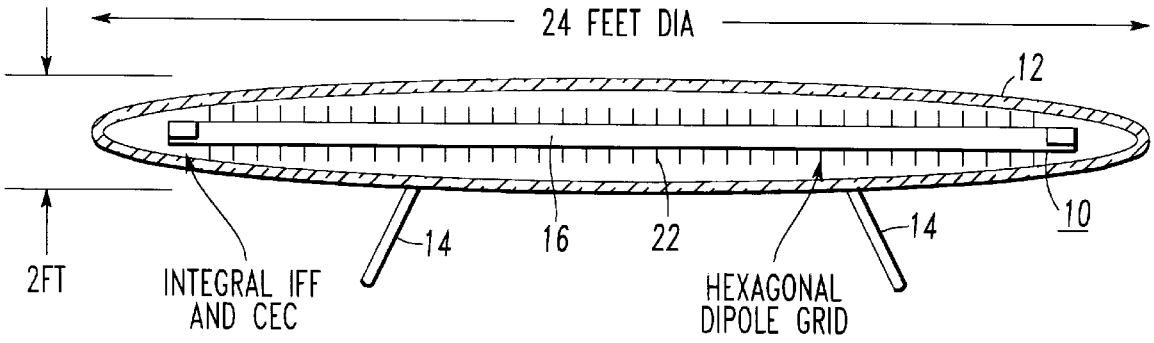
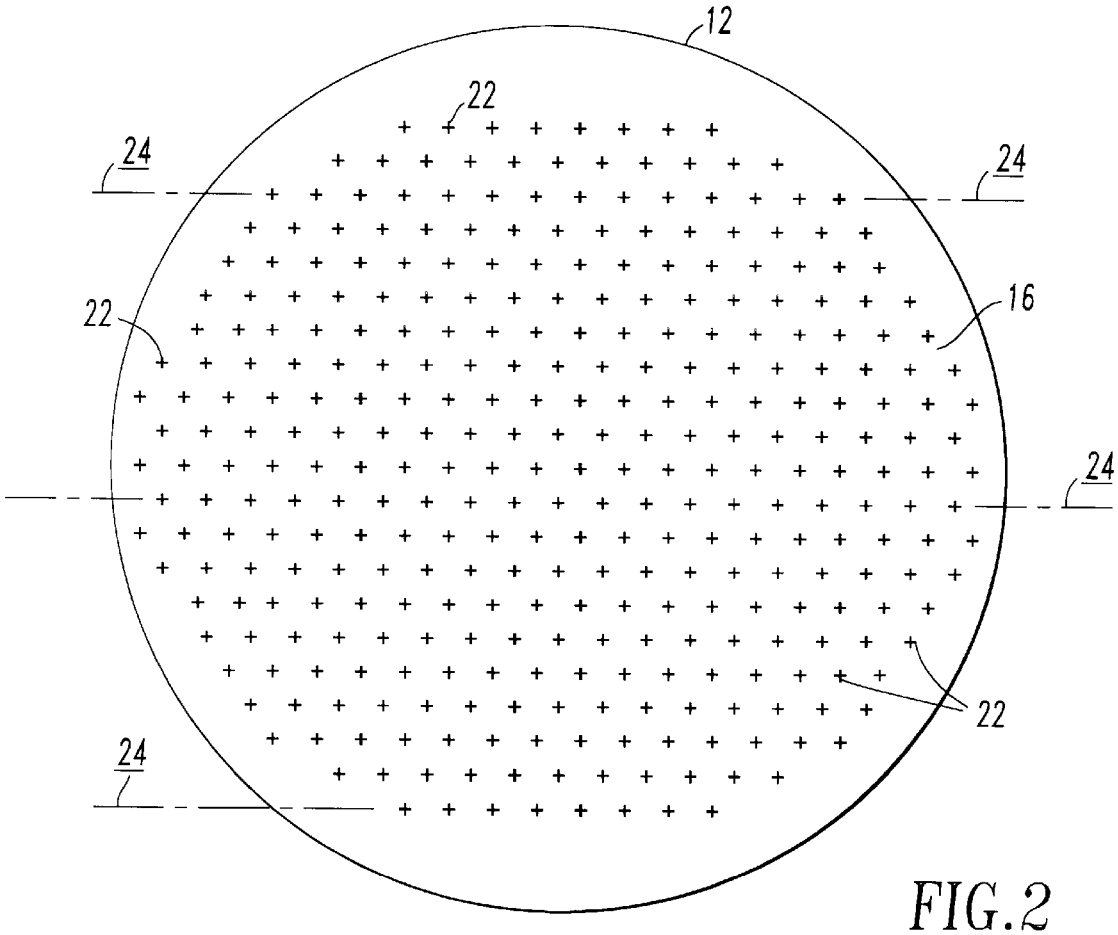
FIG. 2

FIG. 3
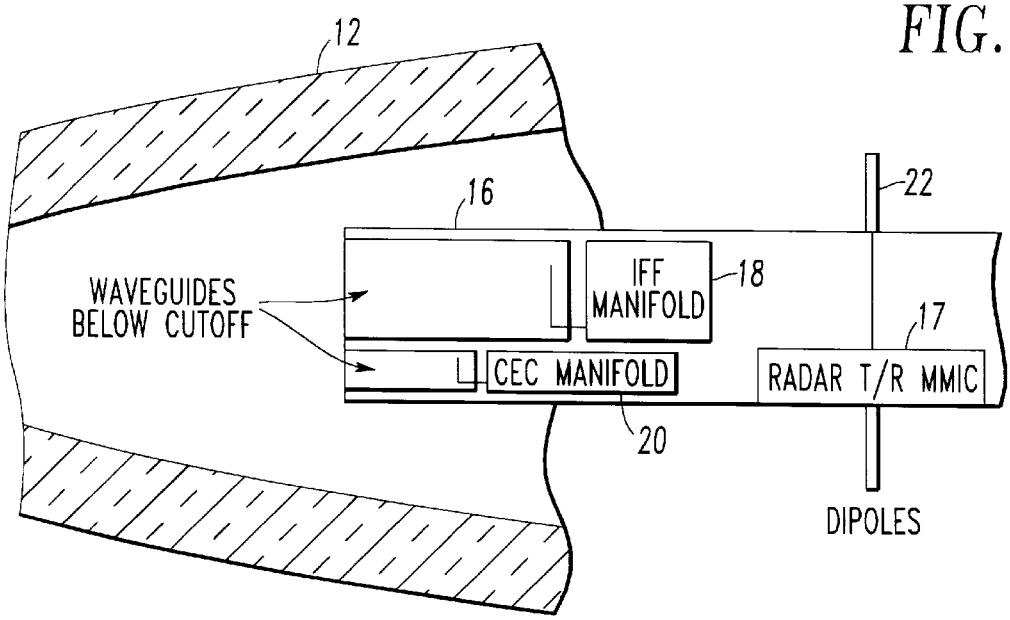
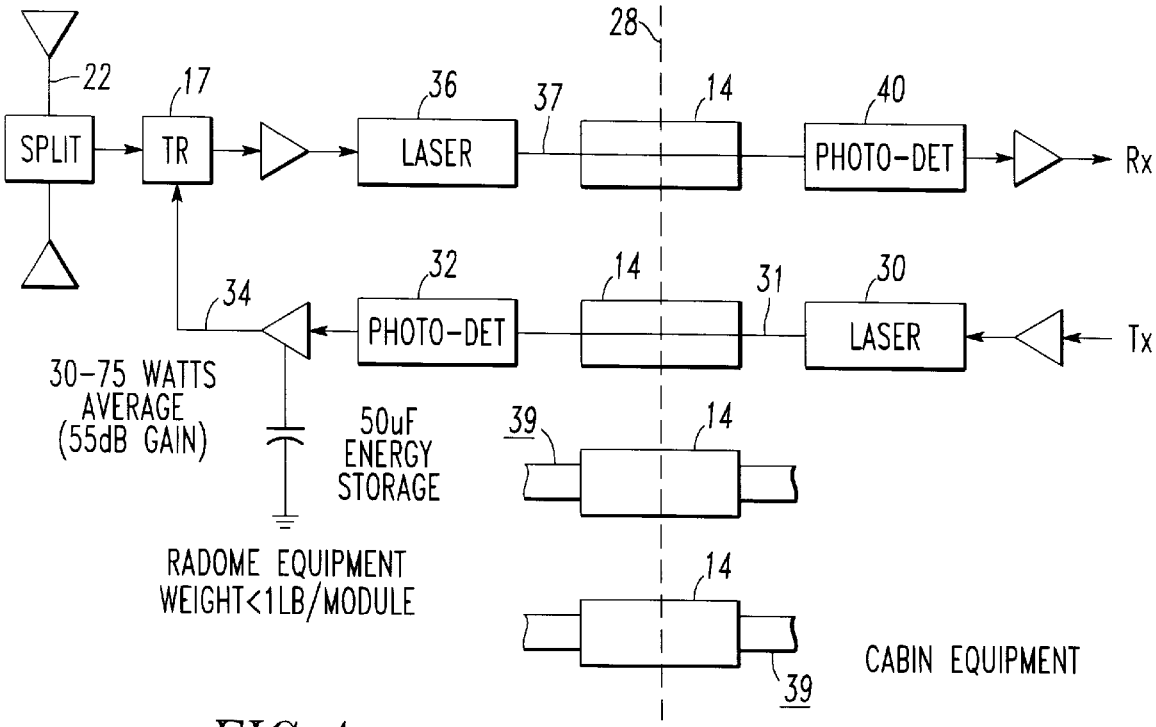
FIG. 4

FIG.5
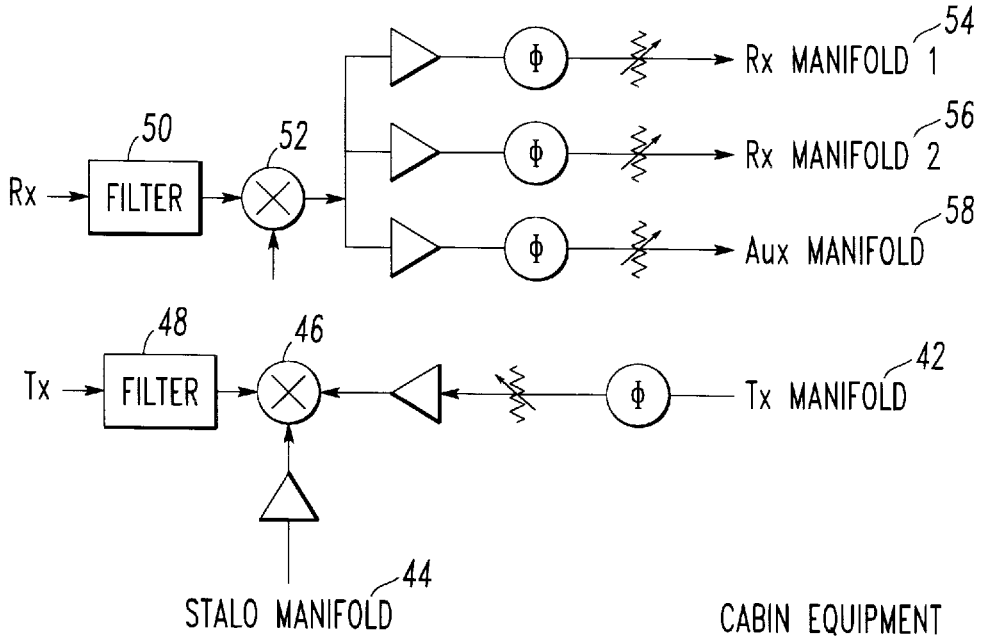
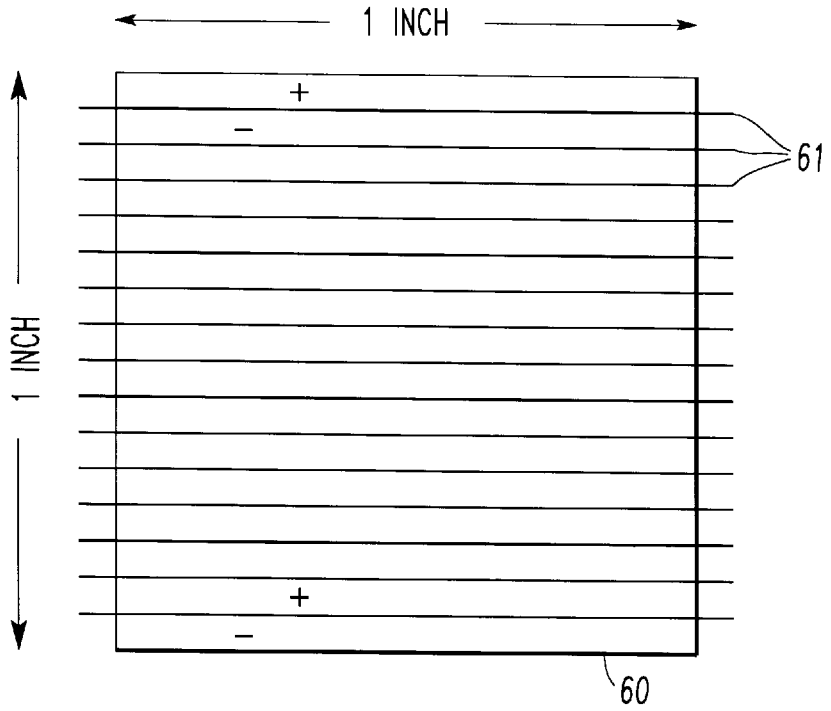
FIG.6
39
$Z_0$=0.125 Ohms
$Z_{0_12}$=0.010 Ohms

STEERABLE DISK ANTENNA

BACKGROUND OF THE INVENTION

The present invention relates to antenna arrays for radar systems, and, more particularly, to electronically steerable radar arrays adaptable for use in aircraft surveillance radar systems.

Antenna arrays for aircraft surveillance radar systems require high gain, wide-band operation and low aerodynamic loading with full 360 degree azimuth scanning capability. Such radar systems can be mounted on aircraft which operate in flight in an Airborne Early Warning (AEW) system.

The designs of prior AEW type antenna arrays have encumbered this type of antenna arrays with general inflexibility, excessive aerodynamic loading, disadvantages of mechanical scanning operation, and/or limited electronic scanning capability.

In prior antenna arrays having electronic scanning, large apertures placed parallel to the air stream have employed high-gain radiating elements and have thus provided high antenna gain with aerodynamic loading limited through control of the antenna frontal area. Dorsal fins, billboards attached to the sides of aircraft, triad phased and other structures have housed AEW type antenna arrays, but none of these approaches has been entirely successful in meeting gain, aerodynamic, and electronic scanning objectives together.

A basic problem results from the fact that placement of large apertures parallel to the air stream provides required high antenna gain but simultaneously makes it difficult to produce full-azimuth electronic scanning. Electronic steering systems in most prior art systems cannot provide beam steering sufficiently forward or aft to achieve 360 degree scanning primarily because of the side-looking location of radiating elements in the arrays placed parallel to the air stream.

In a more recent development, as disclosed in U.S. patent application Ser. No. 08/489,569, entitled INTEGRATED FULL COVERAGE ANTENNA MODULE, filed on Jun. 12, 1995 by Timothy G. Waterman et al, and assigned to the current assignee, an antenna array is provided with end fire arrays positioned on and under opposed side-looking arrays. This module achieves full scanning, but it employs high-gain, end-fired radiating elements with little or no elevation scanning capability, has otherwise generally limited scanning flexibility, and carries other disadvantages of the prior conventional side-looking antenna arrays.

A need has thus existed for a better antenna array adaptable for AEW surveillance applications with more flexible electronic scanning, reduced aerodynamic loading, and generally more effective surveillance.

SUMMARY OF THE INVENTION

A radar antenna system is adapted to be supported on an aircraft for surveillance. The antenna system comprises a nonconducting disk radome structured with aerodynamic fairing and otherwise to produce relatively low aerodynamic drag, and means are provided for securing the disk radome to the aircraft with the disk radome generally extending in a solid horizontal reference plane.

Means are provided for supporting a plurality of elongated, relatively low gain radiating elements relative to the disk radome, with the radiating elements distributed across and within the disk radome and disposed to radiate generally in the vertical direction.

Means are provided for sending and receiving radio frequency signals to and from the radiating elements, with the sending and receiving means disposed within and supported relative to the disk radome. Means are provided for coupling, through the supporting means, signals between the electronic system in the disk radome and radar system level circuitry located externally of the disk radome.

BRIEF DESCRIPTION OF THE DRAWINGS

The accompanying drawings, which are incorporated in and constitute a part of this specification, illustrate a preferred embodiment of the invention and together with the description, provide an explanation of the objects, advantages and principles of the invention. In the drawings:

FIG. 1 is a schematic sectional view of a disk antenna having a radome housing and arranged in accordance with the invention;

FIG. 2 is a schematic top view of the disk antenna of FIG. 1;

FIG. 3 is an enlarged partial sectional view of the disk antenna of FIG. 1 illustrating some internal structure in greater detail;

FIG. 4 is a schematic diagram of electronic circuitry employed in conveying and receiving radio frequency signals to and from transmit/receive modules located in the radome and connected, therein, to respective radiating elements;

FIG. 5 schematically illustrates aircraft cabin circuitry used to operate the transmit/receive modules and control the antenna beam scanning; and FIG. 6 is a diagram of a low impedance power feed for transmitting energy from the aircraft cabin to the antenna circuitry in the radome.

DISCLOSURE OF THE INVENTION

A disk antenna is structured in accordance with the invention to operate with electronic steering and without any rotating assemblies in AEW and other applications. The disk antenna is a three-dimensional antenna which provides improved radio frequency beam steering at least up to 30 degrees in elevation and through 360 degrees in azimuth. As a result, the antenna provides scanning operation over a greater surveillance volume, and enables detection and tracking of tactical ballistic missiles and air targets.

The disk antenna provides high gain and wide band operation for surveillance agility. The antenna structure preferably employs a small frontal area and a small height-to-diameter ratio which minimize aerodynamic effects. High antenna gain results from use of numerous low gain radiating elements distributed to radiate from the full volume of the disk 10. In contrast, conventional antennae typically use high gain radiating elements through the face of a planar surface.

More particularly, as shown in FIGS. 1 and 2, a disk antenna 10 is structured in accordance with the invention, preferably to be housed in a nonconducting, dielectric radome 12 which may be supported by four struts 14, a pedestal (not shown), or other suitable support structure on the top of an aircraft (not shown) in an AEW system. The radome 12 is disk shaped and ellipsoidally cross-sectioned to provide aerodynamic fairing (edge shaping to minimize aerodynamic drag). A state-of-the-art E2 radome can be used for the radome 12.

The antenna 10 preferably includes a ground-plane conductive box 16 which, along with the radome 12, is supported on the struts 14. The ground-plane box 16 is preferably hexagonally shaped to fit within the radome 12, and otherwise has sufficient internal volume to house transmit/receive (TR) circuitry for individual radiating elements and, preferably, to house a conventional Interrogator Friend or Foe (IFF) antenna 18 (FIG. 3) and a conventional Cooperative Engagement Capability (CEC) antenna 20.

The antenna 10 preferably further includes multiple, vertical radiating elements 22 mounted to extend outwardly of the ground-plane box 16. The elements 22 are preferably provided in the form of dipoles in an end fire configuration (i.e., forward and aft), with opposite poles of the elements 22 extending upwardly and downwardly from the ground box 16 within the radome 12. The dipoles 22 near the outer periphery of the disk have a reduced length to meet space limitations and to provide impedance matching.

With the use of dipoles as preferred, elements the dipoles are vertically polarized, i.e. with a vertical E-field but no horizontal E-field. A ground-plane exists within the dipole field but no null exists on the horizon, since the E-field is perpendicular to the ground plane and the upper and lower dipole fields fill in the diffraction otherwise caused by ground-plane edge.

As shown in FIG. 2, the dipoles 22 are preferably distributed across the ground-plane box 16 in a regular pattern, i.e., preferably spaced along a plurality of rows 24. In this embodiment, a total of twenty-one rows are provided in a hexagonal grid, and a total of three hundred thirty-four dipoles are employed. The number of dipoles 22 in a row 24 varies according to the row length.

A TR module 17 (FIG. 3) drives each dipole 22, normally subject to beam and phase control from a system (cabin) level. With the use of beam and phase control principles, the dipoles 22 can be driven to produce a scanning beam at least from 0 to 25 degrees in elevation and through 360 degrees azimuth.

Preferably, each radiating element and its associated electronics (TR module) are structured as a modular unit to facilitate replacement if required for maintenance purposes. The TR modules 17 are preferably fabricated in the form of monolithic microwave integrated circuits (MMIC units).

In other applications of the invention, radiating elements other than dipoles can be employed. For example, monopoles can be employed.

In the prior art, AEW type antennas typically use relatively few high gain radiating elements to collect return energy along edges of the antenna housing. The invention, in contrast, employs numerous low gain radiating elements to collect return energy across the total area of the top and bottom surfaces of the radome 12. Further, the prior art high gain radiating elements, while providing higher individual unit gain, cause a narrowing of beam width which degrades scanability.

The structure and operation of the radiating elements 22 within the antenna 10 enable beam scanning to be flexibly configured. In other words, a radar operator or an automatic controller can readily provide variable patterns of elevation and azimuth scanning as warranted by circumstances.

As shown in FIG. 4, electronic circuitry housed in the radome 12 preferably interfaces (as indicated by interface 28) with electronic circuitry housed in the aircraft cabin so as to minimize weight in the radome 12. In the cabin where greater toleration exists for the weight of necessary processing circuitry, a pulse radar processor (not shown) and other system circuitry (not shown) develop RF transmit signals and process received RF signals for target display.

The transmit signals are applied to a laser converter 30 in the cabin to convert the transmit RF signals to optical signals which are conducted through optical 31 fibers to a photo-detector 32 in the radome 12. The photo-detector 32 converts the optical signals to RF electronic signals and applies them to a dipole 22 through a TR module 17 in a transmit path 34.

The dipole 22 also receives RF signals which are coupled through the TR module 17 to a laser converter 36 in a receive path 38. The laser converter 36, located in the radome 12, converts the electronic RF signals to optical signals which are conducted by optical fibers 37 from the radome 12 to a photo-detector 40 in the cabin for conversion back to RF signals. Receiver and other processing circuitry process these RF signals for target display.

As an alternative to laser coupling, the antenna 10 can be coupled to the cabin equipment through conventional coaxial cable (not shown).

As shown in FIG. 5, the cabin circuitry includes a transmitter having a transmit manifold 42 and a STALO manifold 44 which generate signals for mixing in a mixer 46. The mixer output is filtered by a filter 48 and then optically converted for conduction to the radome 12.

The cabin circuitry further includes receiver circuitry, i.e. a filter 50 processes received RF signals for mixing with the STALO output in a mixer 52. The mixer output is coupled to receiver manifolds 54 and 56 and an auxiliary manifold 58.

The optical fibers 31 and 37 provide a communication link between the cabin and the radome 12, and extend through the struts 14 for end connections in the cabin and the radome 12. In addition, a low impedance DC power feed 39 is routed through the struts 14 to reduce energy storage requirements in the radome 14. Thus, heavy energy storage can be placed in capacitors in the cabin, with rapid energy delivery provided to the radome circuitry, as needed for radar pulse transmission and other purposed, through multiple laminated aluminum cables 60 (FIG. 6).

Each cable preferably has a two-way resistance of 0.003 ohms per 50 feet. With twelve cables extending through the struts 12 (FIG. 4) and having the dimensions shown, each cable would dissipate 50 watts and weigh 60 pounds.

As shown in FIG. 5, each cable is a laminated structure. Thus, insulative disks 61 separate the cable into successive conductive sections insulated from each other. The cable in FIG. 5 is one of twelve cables which extend through the four struts from the cabin to the radome 12 for coupling to the electronic system in the radome 12.

The foregoing description of the preferred embodiment has been presented to illustrate the invention without intent to be exhaustive or to limit the invention to the form disclosed. In applying the invention, modifications and variations can be made by those skilled in the pertaining art without departing from the scope and spirit of the invention. It is intended that the scope of the invention be defined by the claims appended hereto, and their equivalents.

What is claimed is:

1. A radar antenna system adapted to be supported on an aircraft for surveillance, the antenna system comprising:

a nonconducting disk radome structured with aerodynamic fairing and otherwise to produce relatively low aerodynamic drag;

a support system for securing the disk radome to the aircraft with the disk radome generally extending in a solid horizontal reference plane;

a ground plane structure supported by the disk radome and extending generally horizontally across and within the disk radome;

a plurality of elongated, relatively low gain linear radiating elements distributed in spaced relation to each other as opposing pairs within and across the disk radome and supported relative to the disk radome by the ground plane structure to extend substantially in a vertical direction with respective poles of each radiating element disposed on opposite sides of the ground plane structure so at to radiate in a generally vertical direction;

an electronic system having transmit/receive circuits disposed within and supported relative to the disk radome and respectively connected to the radiating elements to transmit radio frequency signals therebetween; and a system for coupling, through the support system, signals between the electronic system in the disk radome and radar system level circuitry located externally of the disk radome.

2. The antenna system of claim 1 wherein each of the elongated linear radiating elements comprises a dipole radiating element.

3. The antenna system of claim 2 wherein each dipole element of said plurality of dipole radiating elements, and an associated transmit/receive circuit are structured as a modular unit thereby facilitating antenna maintenance.

4. The antenna system of claim 1 wherein the ground plane structure is box-like in form and has sufficient internal space to house and operatively support the electronic system.

5. The antenna system of claim 1, wherein a power cable system is connected to the electronic system and extends through the support system to receive energy from a power supply located externally of the disk radome.

6. The antenna system of claim 5 wherein the support system includes at least one support member, and the cable system includes a plurality of cables.

7. The antenna system of claim 6 wherein the support system includes a plurality of support members spaced from each other and extending downwardly from the disk radome for securance to the aircraft.

8. The antenna system of claim 1 wherein a power cable system is connected to the electronic system and extends through the support system to receive power energy from a power supply located externally of the radome.

9. A radar antenna system adapted to be supported on an aircraft for surveillance, the antenna system comprising:

nonconducting disk radome means structured so as to produce relatively low aerodynamic drag;

means for securing the disk radome means to the aircraft with the disk radome means generally extending in a solid horizontal reference plane;

a plurality of elongated, relatively low gain linear radiating elements;

ground-plane means for supporting the radiating elements within the disk radome, the radiating elements extending outwardly from the round-plane means in mutually opposing pairs of radiating elements facing in opposite directions within the disk radome and disposed to radiate generally in a vertical direction;

means for sending and receiving radio frequency signal to and from the radiating elements; the sending and receiving means disposed within and supported relative to the disk radome; and means for coupling, through the supporting means, signals between the electronic system in the disk radome and radar system level circuitry located externally of the disk radome.

10. The antenna system of claim 9 wherein said linear radiating elements comprise dipole elements.

11. The antenna system of claim 9 wherein said pairs of radiating elements comprise dipoles configured in an end fire configuration, said dipoles being vertically polarized and having opposite poles extending upwardly and downwardly from the ground-plane means within the radome means.

12. The antenna system of claim 9 wherein said linear radiating elements are distributed in a regular pattern across the ground-plane means.

13. The antenna system of claim 12 wherein said regular pattern comprises a plurality of rows of radiating elements.

14. The antenna system of claim 13 wherein said plurality of rows of radiating elements are provided in a hexagonal grid.

* * * * *